US011143478B2

(12) United States Patent
Downey et al.

(10) Patent No.: US 11,143,478 B2
(45) Date of Patent: Oct. 12, 2021

(54) FREE-FLOATING BARREL MOUNTING SYSTEM FOR FIREARM

(71) Applicant: Sturm, Ruger & Comany, Inc., Southport, CT (US)

(72) Inventors: Matthias Downey, Warner, NH (US); Jonathan Philip Mather, Grafton, NH (US); Adam Jay Taylor, Unity, NH (US)

(73) Assignee: STURM, RUGER & COMPANY, INC

( * ) Notice: Subject to any disclaimer, the term of this patent is extended or adjusted under 35 U.S.C. 154(b) by 272 days.

(21) Appl. No.: 16/376,465

(22) Filed: Apr. 5, 2019

(65) Prior Publication Data

US 2020/0318928 A1 Oct. 8, 2020

(51) Int. Cl.
*F41A 21/48* (2006.01)

(52) U.S. Cl.
CPC ..... *F41A 21/485* (2013.01); *F41A 21/487* (2013.01)

(58) Field of Classification Search
CPC ..... F41A 21/487; F41A 21/485
See application file for complete search history.

(56) References Cited

U.S. PATENT DOCUMENTS 487,487 A * 12/1892 Mason ..... F41A 21/482 42/75.02
855,181 A 5/1907 Johnson
1,177,261 A * 3/1916 Nelson ..... F41G 1/26 42/75.01
1,348,702 A * 8/1920 Gabbett-Fairfax ... F41A 21/484 42/75.02
1,373,888 A * 4/1921 Johnson ..... F41A 21/482 42/75.02
1,383,765 A * 7/1921 Schneider ..... F41A 25/00 89/16
1,614,053 A * 1/1927 Wenzel ..... F41A 21/482 42/75.01
2,339,331 A 1/1944 Grigg
(Continued)

OTHER PUBLICATIONS

Practical Machinist, "Thread: different ways of attachingt a barrel+ barrel extension to an aluminum receiver", www.practicalmachinist.com, Copyright 2019, pp. 1-10.
(Continued)

*Primary Examiner* — Michelle Clement
(74) *Attorney, Agent, or Firm* — The Belles Group, P.C.

(57) ABSTRACT

A barrel mounting system for a firearm includes a longitudinal axis, a receiver, and a barrel detachably coupled to the receiver by upper and lower barrel mounting features above and below the barrel bore centerline. The lower mounting feature may comprise a clamping block compressing a lower breech end portion of the barrel against the receiver. In one embodiment, a pair of lower securement fasteners extend through the clamping block and threadably engage the receiver to draw the block into engagement with the receiver. The upper mounting feature may comprise a securement fastener compressing an upper breech end portion of the barrel against the receiver. The upper and lower mounting features form a triangular bolting pattern and balance moment forces created by the compressive forces of coupling the barrel to receiver with the fasteners.

31 Claims, 13 Drawing Sheets

(56) References Cited

U.S. PATENT DOCUMENTS 2,342,705 A * 2/1944 Summerbell ..... F41A 3/82 89/149
2,497,861 A * 2/1950 Brown, Jr. ..... F41A 21/487 42/75.01
2,702,958 A * 3/1955 Boroszewski ..... F41A 21/487 42/75.01
2,732,769 A * 1/1956 Simpson ..... F41A 21/487 89/193
2,747,313 A 5/1956 Crittendon et al.
2,752,714 A * 7/1956 Landwehr ..... F41A 21/487 42/75.01
2,867,931 A 1/1959 Schreiber
2,893,153 A 7/1959 Hailsotn et al.
3,177,603 A 4/1965 Gillespie
3,183,617 A * 5/1965 Ruger ..... F41A 21/484 42/75.02
3,208,178 A * 9/1965 Seiderman ..... F41A 21/48 42/71.01
3,252,237 A * 5/1966 Korzeniewski ..... F41A 21/484 42/75.02
3,323,246 A * 6/1967 Loffler ..... F41A 11/00 42/75.01
3,444,641 A * 5/1969 Ruger ..... F41A 21/485 42/75.03
3,611,611 A * 10/1971 Quinney ..... F41A 21/482 42/75.02
3,630,119 A * 12/1971 Perrine ..... F41A 3/50 89/189
3,661,049 A * 5/1972 Perrine ..... F41A 3/50 89/189
3,721,031 A * 3/1973 Falterman ..... F41C 9/06 42/1.14
3,731,418 A * 5/1973 Birkenhagen ..... F41A 21/481 42/75.02
3,834,053 A * 9/1974 Bielfeldt ..... F41A 21/482 42/75.02
3,972,143 A * 8/1976 Wild ..... F41A 21/485 42/75.01
4,573,394 A 3/1986 Goff et al.
4,648,192 A * 3/1987 Harness ..... F41A 21/10 42/75.04
4,769,938 A * 9/1988 Chesnut ..... F41A 21/02 42/124
5,020,260 A * 6/1991 Houghton ..... F41A 11/04 42/75.01
5,123,194 A 6/1992 Mason
5,247,758 A * 9/1993 Mason ..... F41A 3/86 42/75.02
5,410,834 A * 5/1995 Benton ..... F41A 21/482 42/75.02
5,454,182 A 10/1995 Lewis et al.
5,540,008 A * 7/1996 Kirnstatter ..... F41A 21/484 42/75.02
5,706,599 A * 1/1998 Knight ..... F41A 21/485 42/124
5,907,919 A * 6/1999 Keeney ..... F41A 21/485 42/75.02
6,223,458 B1 * 5/2001 Schwinkendorf ..... F41A 21/00 42/1.06
6,470,616 B1 * 10/2002 Clay ..... F41A 11/00 42/75.01
6,487,805 B1 * 12/2002 Reynolds ..... F41A 21/485 42/75.03
6,637,142 B1 * 10/2003 Reynolds ..... F41A 21/485 42/1.06
7,104,000 B2 * 9/2006 Orth ..... F41A 11/04 42/71.01
7,302,881 B1 * 12/2007 Tertin ..... F41A 11/02 42/69.02
7,451,564 B2 * 11/2008 Wait ..... F41A 21/482 42/75.02
7,685,757 B2 * 3/2010 Rohrauer ..... F41A 11/02 42/75.01
7,735,409 B1 * 6/2010 Tertin ..... F41A 11/02 89/128
7,841,121 B1 * 11/2010 Barrett ..... F41A 11/04 42/75.02
7,905,041 B1 * 3/2011 Davies ..... F41A 21/482 42/75.02
8,046,949 B1 * 11/2011 Daniel ..... F41C 23/16 42/75.02
8,069,604 B2 * 12/2011 Larue ..... F41C 23/16 42/75.1
8,087,194 B1 * 1/2012 Vuksanovich ..... F41A 21/48 42/75.02
8,230,633 B1 * 7/2012 Sisk ..... F41A 21/485 42/75.01
8,234,808 B2 * 8/2012 Lewis ..... F41C 23/16 42/73
8,397,415 B2 * 3/2013 Laney ..... F41C 23/16 42/75.02
8,505,227 B2 * 8/2013 Barrett ..... F41A 21/484 42/75.02
8,539,708 B2 * 9/2013 Kenney ..... F41A 21/485 42/75.02
8,578,643 B2 * 11/2013 Hasler ..... F41C 23/16 42/75.03
8,714,144 B2 5/2014 Zadra
8,910,408 B2 * 12/2014 Masters ..... F41A 21/484 42/75.02
9,057,576 B2 * 6/2015 Barrett ..... F41A 21/481
9,140,506 B2 * 9/2015 Gomez ..... F41C 23/20
9,285,178 B2 3/2016 Sellars
9,631,885 B2 * 4/2017 Jones ..... F41A 19/11
9,658,020 B2 * 5/2017 Daniel ..... F41C 23/16
9,664,472 B1 * 5/2017 Kidd ..... F41A 11/00
9,702,652 B1 * 7/2017 Jackson ..... F41A 3/66
10,352,643 B2 * 7/2019 Battaglia ..... F41A 21/482
10,386,149 B1 * 8/2019 Facchini ..... F41A 21/484
10,921,081 B2 * 2/2021 Pichler ..... F41A 21/487
2005/0188584 A1 * 9/2005 Orth ..... F41A 11/04 42/71.01
2005/0188591 A1 * 9/2005 Stone ..... F41A 21/485 42/75.02
2006/0277810 A1 * 12/2006 Leitner-Wise ..... F41G 11/003 42/75.03
2008/0066361 A1 * 3/2008 Aalto ..... F41A 21/485 42/76.01
2008/0190005 A1 * 8/2008 Rohrauer ..... F41A 21/484 42/75.01
2010/0175290 A1 * 7/2010 Duplessis ..... F41A 21/482 42/16
2010/0319231 A1 * 12/2010 Stone ..... F41C 23/00 42/71.01
2011/0094136 A1 * 4/2011 Zimmerman ..... F41A 3/66 42/6
2012/0073179 A1 * 3/2012 Young ..... F41A 21/485 42/75.02
2012/0131835 A1 * 5/2012 Barrett ..... F41A 21/481 42/75.02
2012/0186123 A1 * 7/2012 Troy ..... F41C 23/16 42/71.01
2012/0204465 A1 * 8/2012 Hasler ..... F41C 23/16 42/75.03
2012/0311908 A1 * 12/2012 Kenney ..... F41A 21/485 42/75.02
2013/0219765 A1 * 8/2013 Ibarguren ..... F41A 21/485 42/75.02
2013/0291420 A1 * 11/2013 Aalto ..... F41A 21/485 42/75.02
2014/0076146 A1 3/2014 Gomez
2014/0115938 A1 * 5/2014 Jarboe ..... F41C 23/16 42/71.01
2014/0165444 A1 * 6/2014 Masters ..... F41A 21/484 42/75.02
2014/0345179 A1 * 11/2014 Adair ..... F41C 23/16 42/75.02

(56) References Cited

U.S. PATENT DOCUMENTS

| | | | | |
|---|---|---|---|---|
| 2015/0135572 | A1* | 5/2015 | Davies | F41C 23/16 42/71.01 |
| 2015/0308779 | A1* | 10/2015 | McGinty | F41A 21/484 42/75.02 |
| 2016/0033225 | A1* | 2/2016 | Selvetti | F41A 21/484 89/14.05 |
| 2016/0091276 | A1* | 3/2016 | Miller | F41C 23/16 42/75.02 |
| 2017/0184368 | A1* | 6/2017 | Cheng | F41A 21/484 |
| 2017/0268844 | A1* | 9/2017 | Smith | F41A 21/487 |
| 2018/0080733 | A1* | 3/2018 | Battaglia | F41A 11/02 |
| 2018/0112939 | A1* | 4/2018 | Wheatley | F41A 35/06 |
| 2019/0086175 | A1* | 3/2019 | Karagias | F41A 21/482 |
| 2019/0101355 | A1* | 4/2019 | Hubbell | F41C 23/16 |
| 2019/0113297 | A1* | 4/2019 | Turlakov | F41A 21/485 |
| 2019/0301827 | A1* | 10/2019 | Chebanova | F41A 21/487 |
| 2020/0318928 | A1* | 10/2020 | Downey | F41A 21/487 |
| 2020/0333097 | A1* | 10/2020 | Hendricks | F41A 21/482 |

OTHER PUBLICATIONS

International Search Report and Written Opinion for International Application No. PCT/US20/26372 dated Sep. 30, 2020.

* cited by examiner

FREE-FLOATING BARREL MOUNTING SYSTEM FOR FIREARM

BACKGROUND

The present invention generally relates to firearms, and more particularly to a free-floating barrel mounting system for firearms such as rifles or carbines.

To improve the shooting accuracy of long guns such as rifles or carbines especially for competition shooting, it is often desirable to provide a free-floating barrel. Such barrels are coupled to the receiver and typically receive no significant support from the stock, chassis, or handguard. Because there is no physical coupling between the barrel and stock or handguard in true free-floating barrel designs, the barrel is not restrained allowing it to grow and expand freely when heated by repeated firing of the rifle to avoid thermal distortion.

Improvements in barrel mounting systems are desired.

SUMMARY OF THE INVENTION

Embodiments of the present invention provide an improved barrel mounting system for coupling the barrel to the receiver in a manner which provides a free-floating barrel mount. The firearm may be a long gun such as a rifle or carbine as some non-limiting examples.

The free-floating barrel mounting system generally includes upper and lower barrel mounting features above and below the barrel bore centerline respectively which detachably couple the barrel to the receiver. The mounting features are configured and operable to compress a flat rear face of the barrel against a mating flat front face of the receiver for retaining the barrel. The lower mounting feature may comprise an assembly of a clamping block and pair of securement fasteners threadably engaged with the receiver which compress a lower breech end portion of the barrel against the receiver. The upper mounting feature may comprise a single securement fastener engaged with the receiver which compresses an upper breech end portion of the barrel against the receiver. In one embodiment, the upper securement fastener is centered over the breech end of the barrel. The upper and lower securement fasteners form a triangular bolting pattern and advantageously balance moment forces created by the compressive forces of coupling the barrel to receiver with the fasteners.

In one aspect, a free-floating barrel mounting system for a firearm includes: a longitudinal axis; a receiver; a barrel detachably coupled to the receiver, the barrel comprising a front muzzle end, a rear breech end, and an internal bore defining a bore centerline and extending axially between the ends to define a projectile passageway; a lower mounting feature below the bore centerline comprising a clamping block arranged in proximity to the breech end of the barrel, the clamping block configured to compress a lower portion of the breech end against a front face of the receiver; an upper mounting feature above the bore centerline comprising an upper securement fastener configured to threadably engage the receiver and compress an upper portion of the breech end of the barrel against the front face of the receiver; wherein moment forces created by the lower mounting feature are balanced by the upper mounting feature.

In another aspect, a free-floating barrel mounting system for a firearm includes: a longitudinal axis; a receiver defining a front face and a forward extension projecting axially from the front face; a barrel comprising a front muzzle end, a rear breech end, and an internal bore defining a bore centerline and extending axially between the ends to define a projectile passageway; the breech end of the barrel being cylindrical and received in an unthreaded barrel mounting hole in the front face of the receiver; an external shoulder formed between the breech end and a portion of the barrel forward of the breech end, the shoulder defining an annular rear face abuttingly engaged with the front face of the receiver; a clamping block arranged below the bore centerline and engaged with the forward extension of the receiver; a pair of spaced apart lower securement fasteners extending axially through the clamping block and threadably engaging the forward extension of the receiver; an upper securement fastener arranged above the bore centerline and threadably engaging an axial bore in the front face of the receiver; a portion of the upper securement fastener abuttingly engaging a forward facing upper bearing surface formed on a top of the barrel; wherein tightening the upper securement fastener compresses the annular rear face of the barrel against the front face of the receiver; wherein moment forces created by tightening the lower securement fasteners are balanced by the upper securement fastener.

In another aspect, a method for coupling a barrel to a receiver of a firearm includes: axially aligning the barrel with the receiver; slidably inserting a rear breech end of the barrel into a corresponding barrel mounting hole in a front end of the receiver; abuttingly engaging a rear face of the barrel with a front face of the receiver; engaging a lower forward portion of the receiver with a clamping block below a bore centerline of the barrel; inserting at least one lower securement fastener through the clamping block; threadably engaging a pair of lower securement fasteners with the receiver; tightening the lower securement fasteners to draw and clamp a bottom portion of the barrel against the front face of the receiver; threadably engaging an upper securement fastener with the receiver above the bore centerline of the barrel to trap a portion of the barrel between an enlarged head of the upper securement fastener and the receiver; and tightening the upper securement fastener to draw a top portion of the barrel against the front face of the receiver; wherein moment forces created by tightening the lower securement fasteners is balanced by the upper securement fastener.

BRIEF DESCRIPTION OF THE DRAWINGS

The features of the exemplary embodiments will be described with reference to the following drawings where like elements are labeled similarly, and in which.

Figure 1:
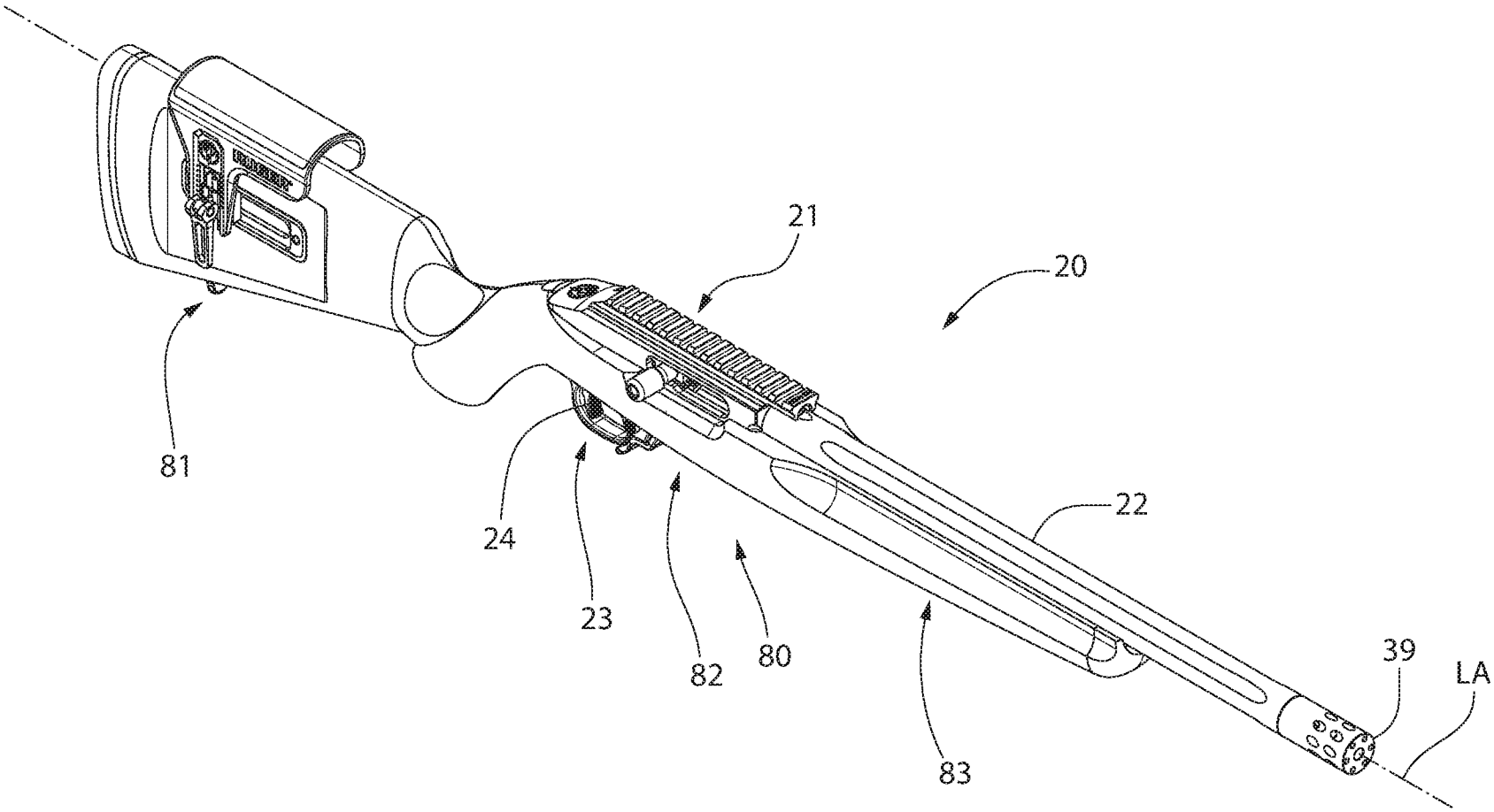
FIG. 1 is a top perspective view of a firearm with barrel mounting system according to the present disclosure.
Figure 2:
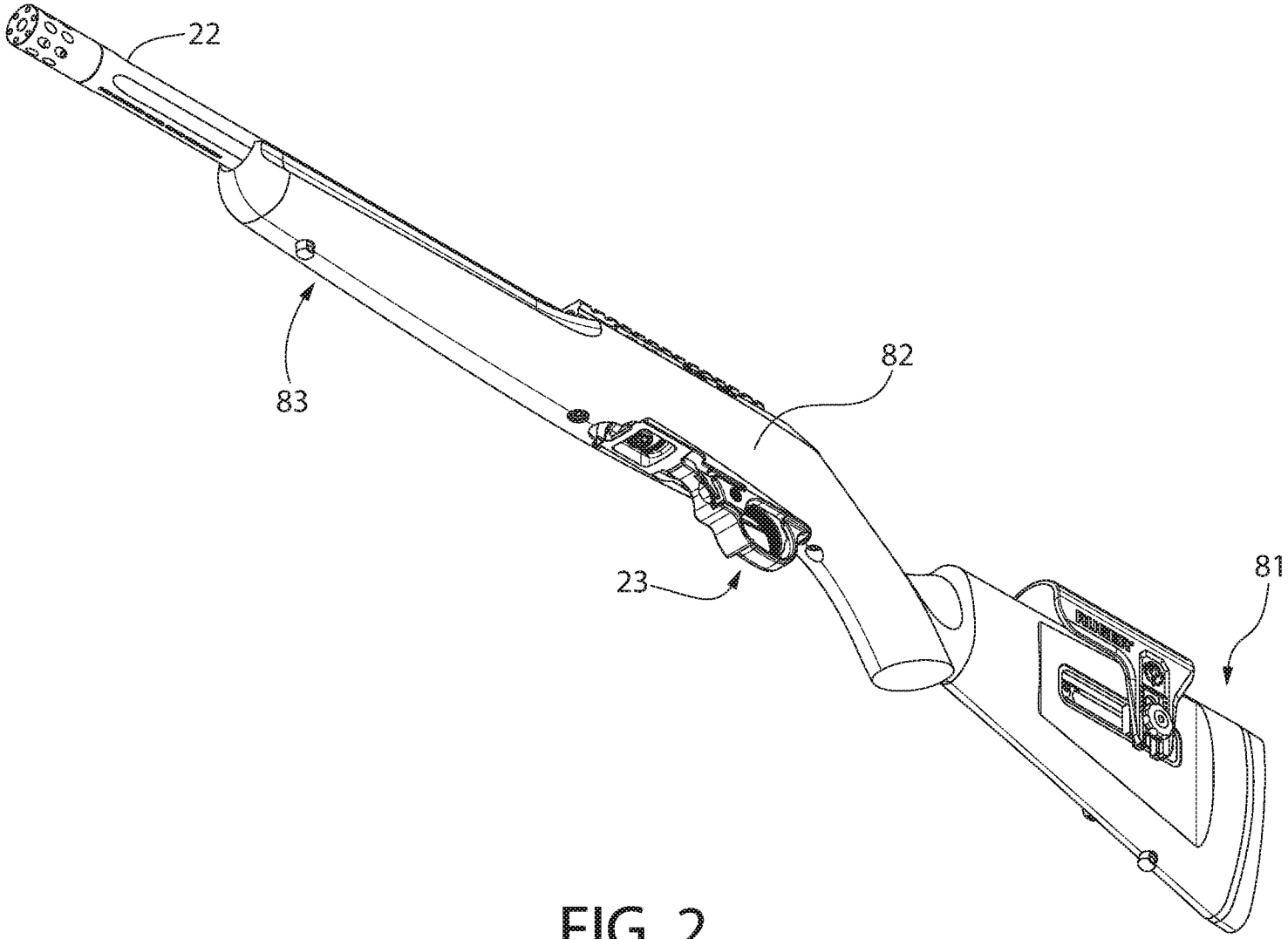
FIG. 2 is a bottom perspective view thereof.

All drawings are schematic and not necessarily to scale. Parts shown and/or given a reference numerical designation in one figure may be considered to be the same parts where they appear in other figures without a numerical designation for brevity unless specifically labeled with a different part number and described herein.

DETAILED DESCRIPTION OF EMBODIMENTS

The features and benefits of the invention are illustrated and described herein by reference to preferred but non-limiting exemplary ("example") embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

FIGS. 1-14 depict various aspect of a magazine-fed semi-automatic firearm 20 including a barrel mounting system according to the present disclosure. In one non-limiting embodiment, the firearm as illustrated may be a rifle. However, the firearm could be any other type of long gun such as a shortened rifle with shorter barrel known as a carbine or a shotgun, as examples, or others. Accordingly, the barrel mounting system is not limited in its applicability to any particular firearm format alone in which it is desirable to a balanced moment force coupling between the barrel and receiver.

Figure 5:
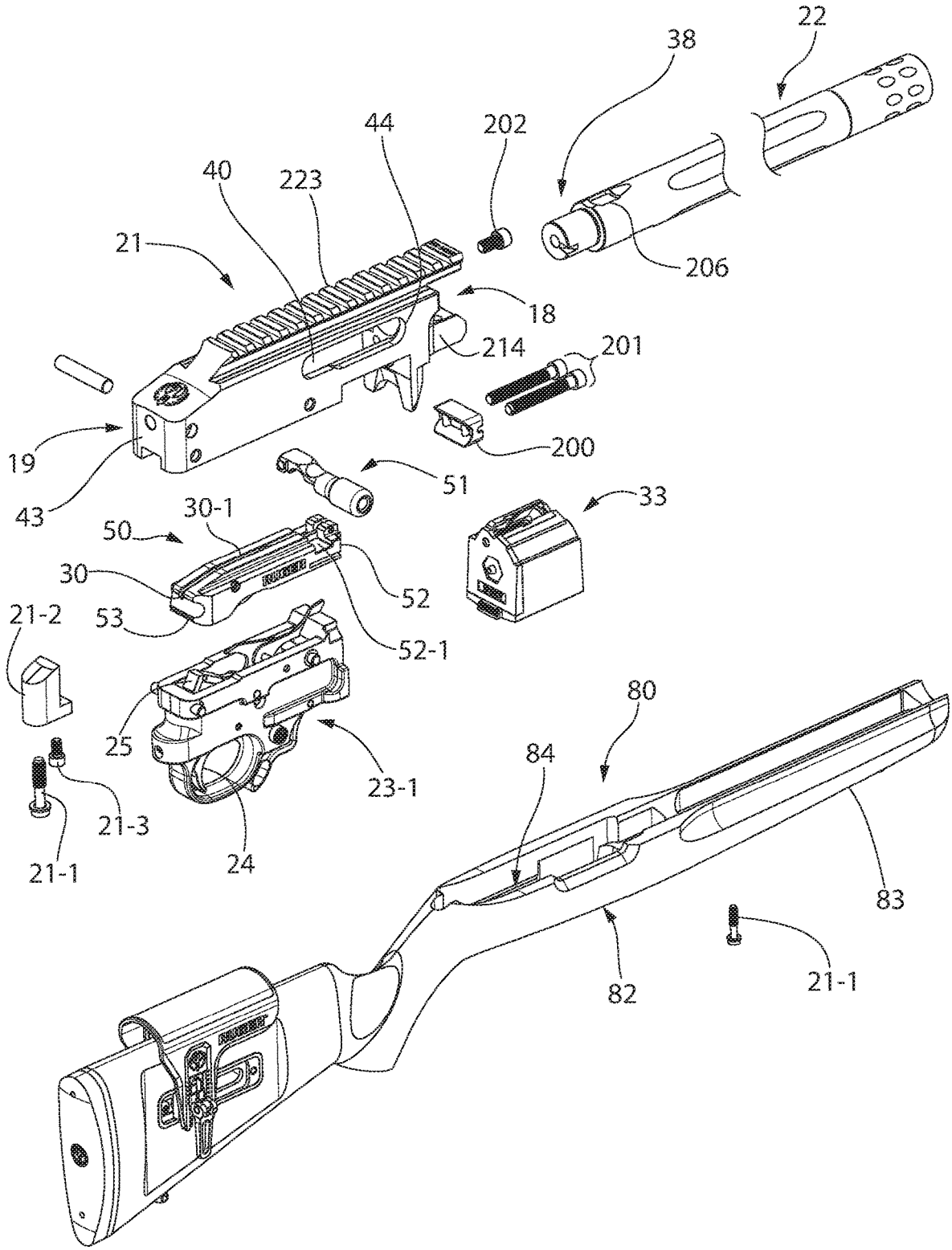
FIG. 5 is an exploded top perspective view of the firearm.
Figure 6:
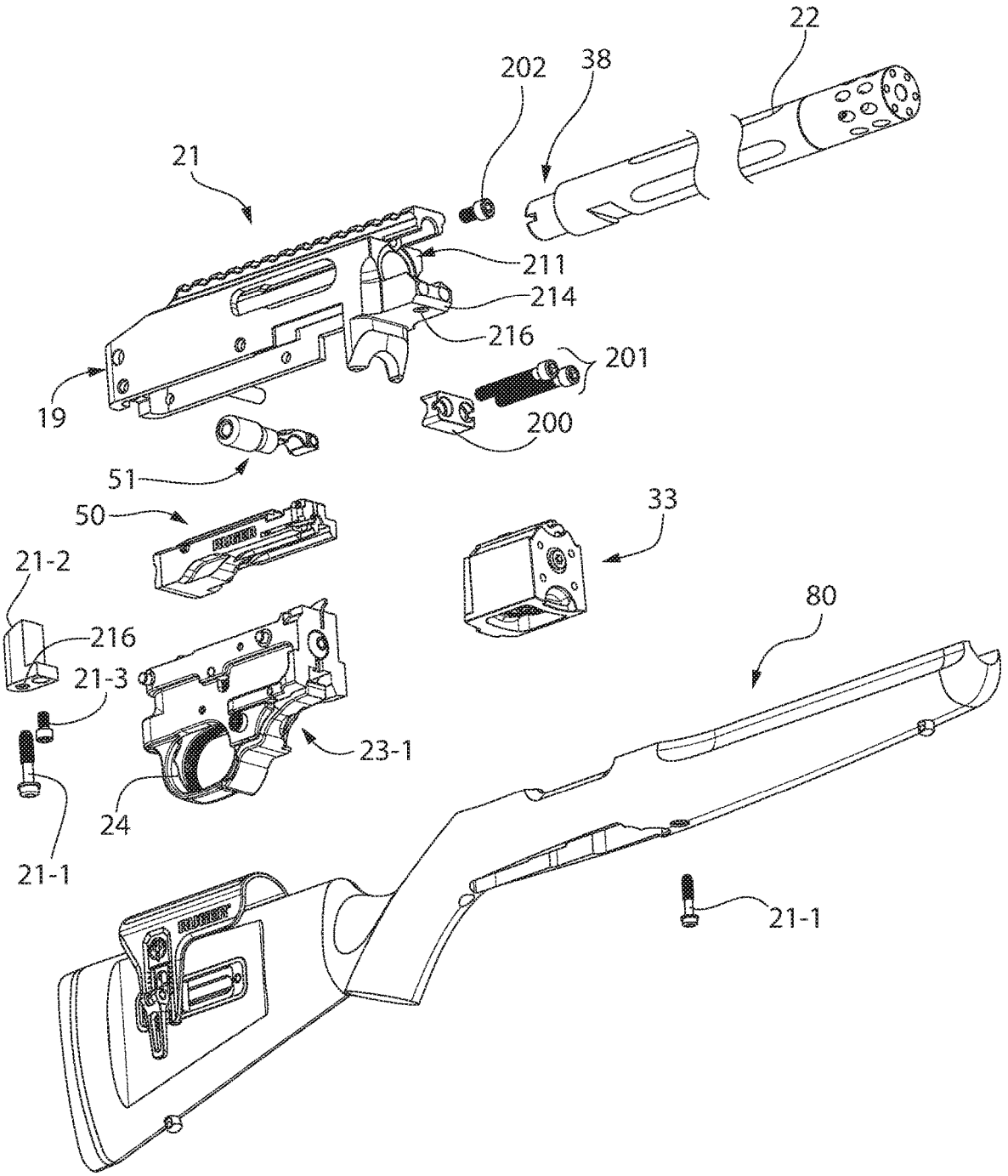
FIG. 6 is an exploded bottom perspective view of the firearm.

Firearm 20 includes a longitudinal axis LA, receiver 21, barrel 22 coupled thereto, bolt 50, and a trigger-actuated firing mechanism 23 which may be supported by the receiver or a detachable trigger housing 23-1 as illustrated. Firing mechanism 23 includes a movable trigger 24 for actuating the mechanism. The firearm includes a chassis or stock 80 including buttstock 81, mid-stock 82 to which the receiver 21 is mounted by a pair of takedown screws 21-1, and a forearm 83 extending for a portion of the length of the barrel 22. As best seen in FIG. 5, the mid-stock 32 defines a longitudinally-extending and upwardly open cavity 84 which receives the receiver 21 at least partially therein when mounted to the stock. Stock 80 may be formed of wood and/or glass-filled polymer in some embodiments. Other materials may be used.

A downwardly open magazine well 32 is formed by the receiver 21 which holds an ammunition magazine 33 comprising a plurality of cartridges detachably mounted in the well. Such magazines may a straight or curved box-style which contains a spring-biased stack of ammunition cartridges which are uploaded into the breech area 34 by a spring mechanism for chambering into the rearwardly open chamber 36 of barrel 22 by the bolt 50 in a conventional manner when cycling the action (example of box magazine illustrated schematically by dashed lines in FIG. 3). In other embodiments, as best shown in FIGS. 4-7, the magazine 33 may be a rotary magazine such as the Ruger® 10-round rotary magazine mounted in magazine well 32 flush with the bottom of the mid-stock 82. In one embodiment, the cartridges may rimfire cartridges with crushable rims to detonate the charge, such as .22LR. However, the cartridges may be centerfire cartridges in other embodiments of the firearm with a centrally located percussion cap in the rear exposed end of the base of the cartridge. Both types of cartridge are well known to those skilled in the art without further undue elaboration.

Figure 4:
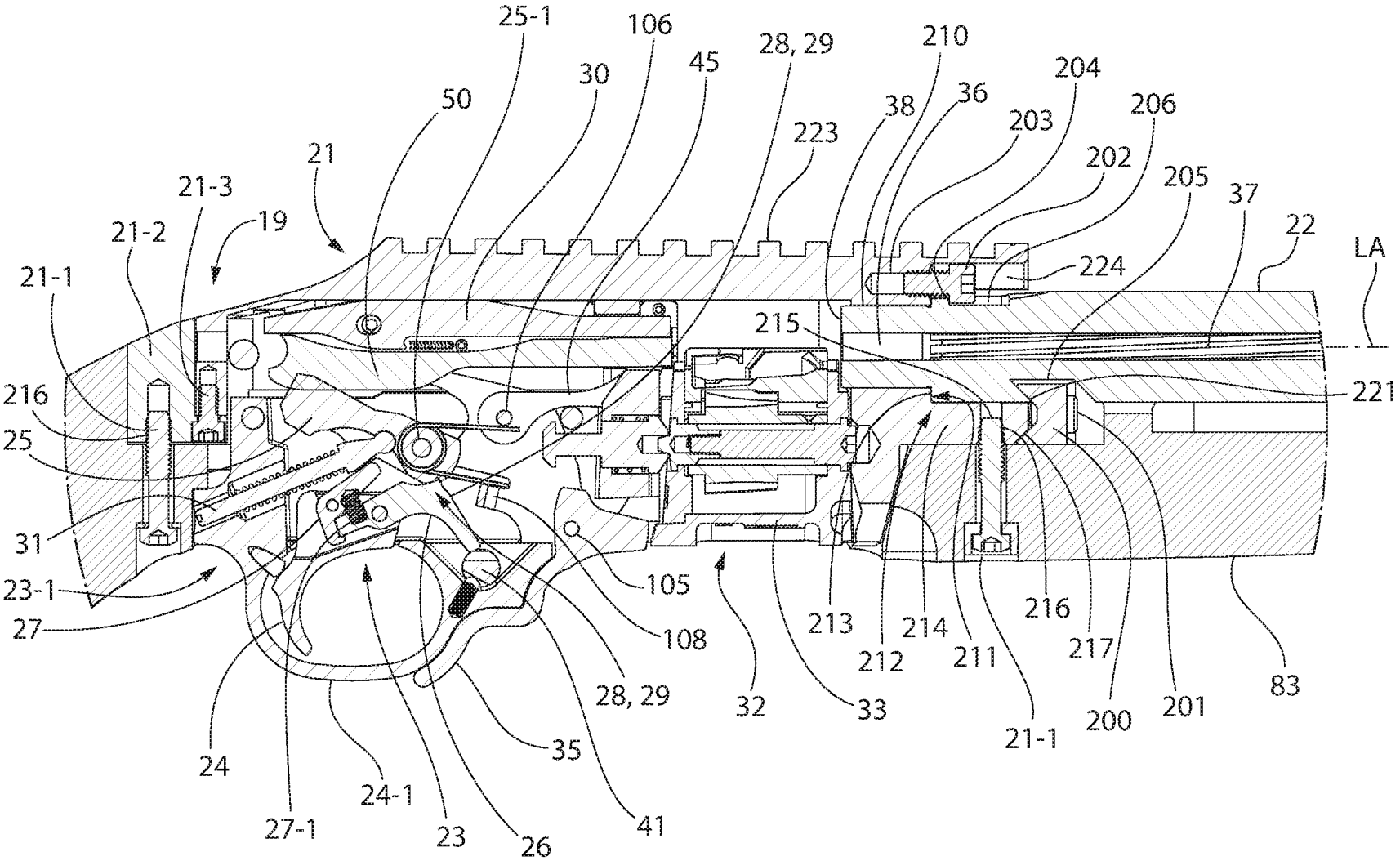
FIG. 4 is an enlarged view taken from FIG. 3 of the barrel to receiver interface of the firearm.

The magazine 33 is removably retained in the magazine well 32 by a pivotable magazine release such as elongated lever latch 35. Latch 35 may be pivotably mounted by transverse pivot pin 105 to the receiver 21, or alternatively as shown in the figures by detachable trigger housing 23-1 which houses the firing mechanism. Latch 35 is mounted proximate to the rear of the magazine well 32 and has a front end configured to engage and retain magazine 33 in the firearm. Latch 35 may have an elongated body which has a compound curved shape complementary configured to the shape of the trigger guard 24-1 as best shown in FIG. 4. When in the rearward latched position shown in these figures for retaining the magazine 33 in magazine well 32, the latch fits the contours of and nests abuttingly against the trigger guard. This form-fitting configuration of the magazine release latch helps prevent accidentally bumping and activating the magazine release latch. To release the magazine 33 from the firearm 20, the user pivots the latch downwards and forward about pivot pin 105 to a forward position.

Barrel 22 has an elongated tubular body including an axial bore 37 extending longitudinally and axially from a rear breech end 38 to a front muzzle end 39 from which a bullet or slug is discharged from the firearm. The centerline of bore 37 is coaxial with and defines the longitudinal axis LA of the firearm. A vertical reference plane VR intersects and extends along the longitudinal axis LA for convenience of description. The rear breech end 38 of the barrel 22 defines a rearwardly open diametrically enlarged chamber 36 configured for holding an ammunition cartridge. Chamber 36 communicates with bore 37 which forms the projectile passageway for the bullet or slug.

Receiver 21 defines an axially elongated internal cavity 40 which slidably carries and supports the bolt assembly 50. Cavity 40 extends along the longitudinal axis LA between the open front end 18 in communication with the barrel chamber 36 for loading cartridges therein and a closed rear end 19 defined by vertical rear end wall 43. Barrel 22 is coupled to the front end 18 of the receiver. In one non-limiting embodiment, the receiver 21 includes an axially elongated right ejection port 44 through which spent cartridge casings are ejected from the firearm after firing by ejector 45 (see, e.g. FIG. 4).

Figure 7:
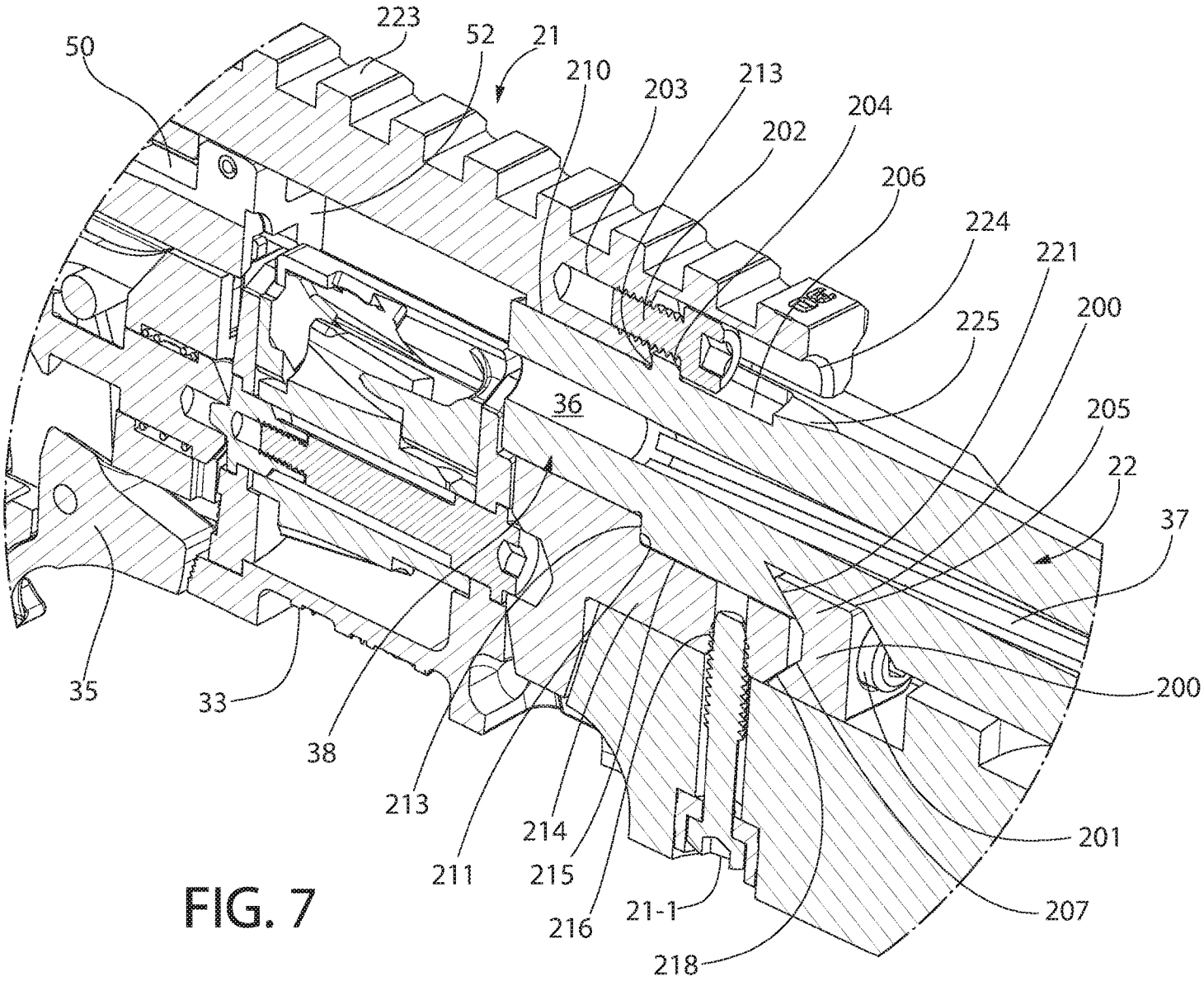
FIG. 7 is an enlarged partial cross-sectional perspective view of the barrel to receiver interface showing the barrel mounting system.
Figure 10:
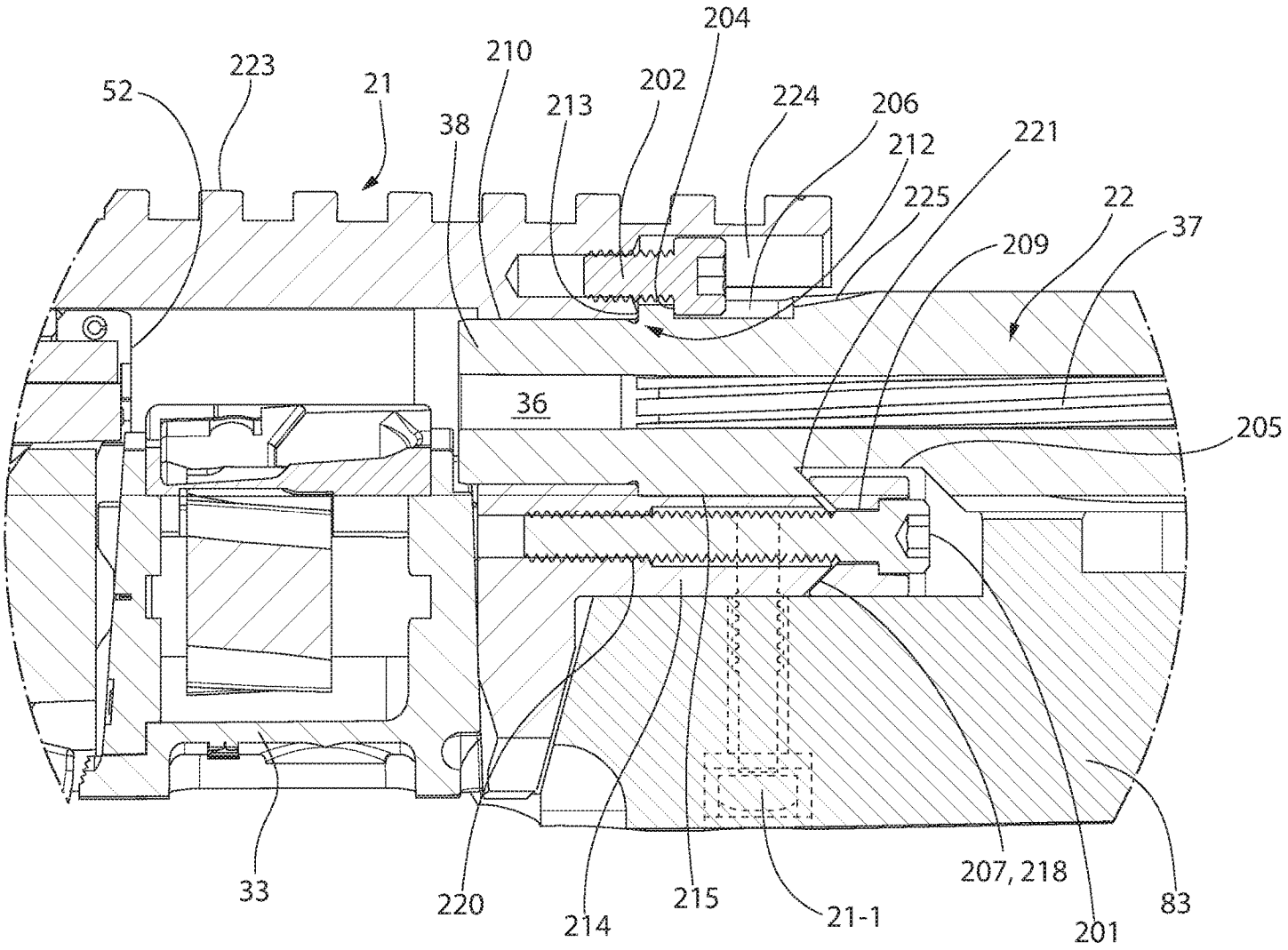
FIG. 10 is a longitudinal cross-sectional view thereof taken from FIG. 8.
Figure 13:
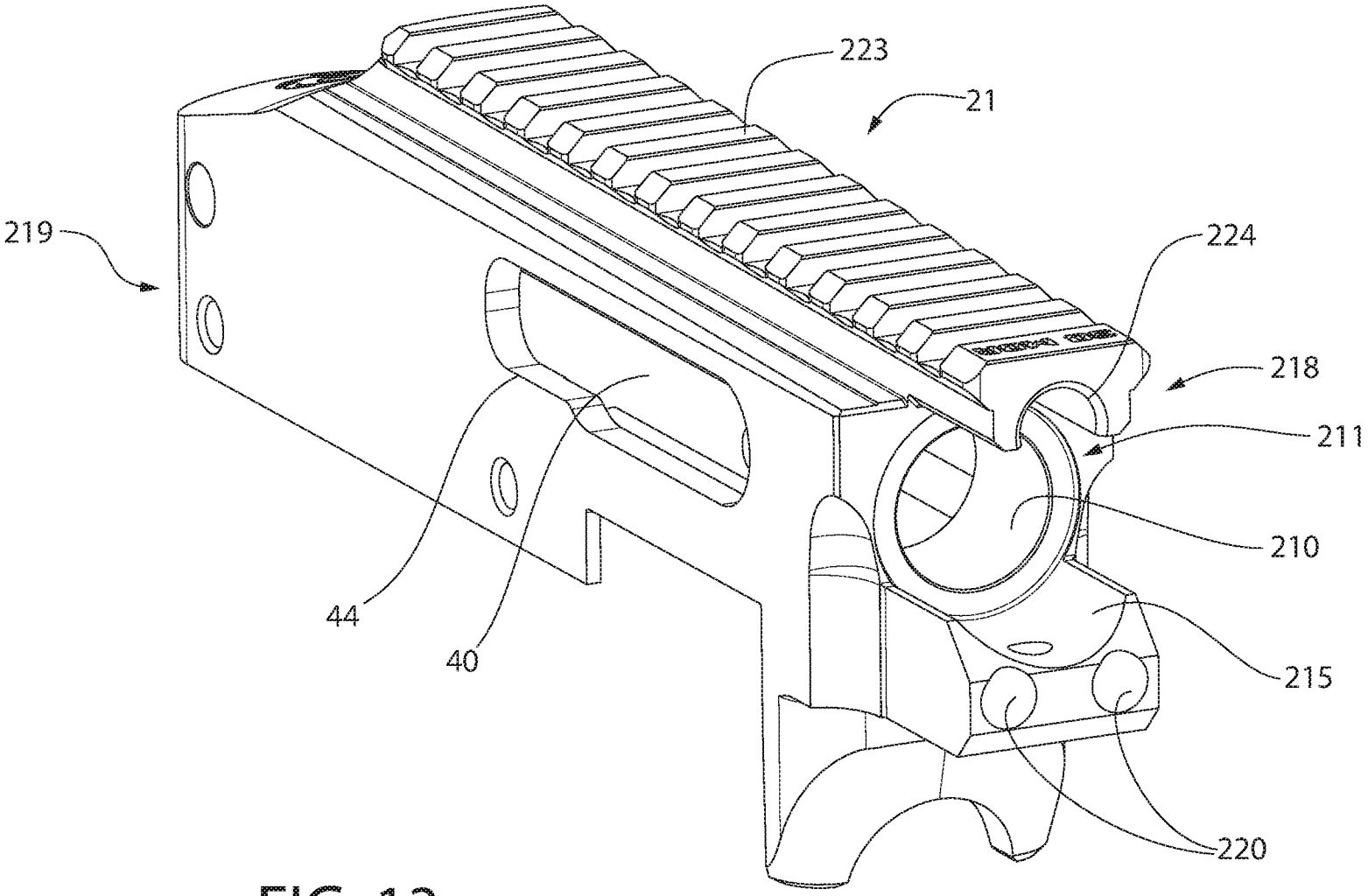
FIG. 13 is a front perspective view of the receiver.
Figure 14:
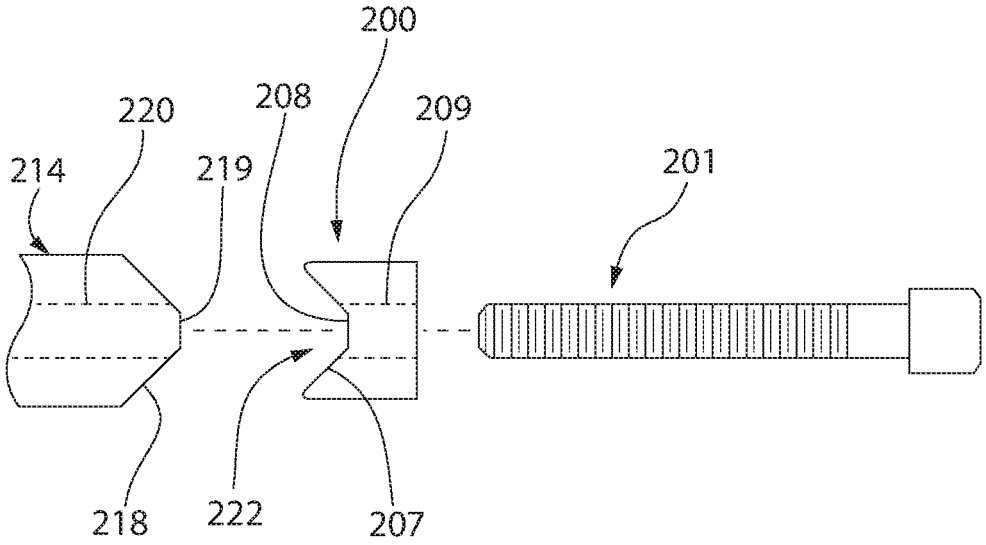
FIG. 14 is a side view of the lower barrel mounting feature components.

For convenience of assembly and maintenance/repair, the firing mechanism 23 may be housed in trigger housing 23-1 best shown in FIGS. 7, 10, and 13. Trigger housing 23-1 is detachably and removably mounted to the lower portion of the receiver 21. The trigger housing 23-1 includes a plurality of transversely oriented pivot pins which movably mount the various firing component in an open internal cavity 23-2 of the housing. A push-able cylindrical manual safety 41 is transversely movably mounted in trigger housing 23-1 and configured to interact with the sear for rendering the firing mechanism in either a safe or fire condition. The trigger housing includes a open loop-shaped bottom trigger guard 24-1 which surrounds and helps protect the trigger 24 against unintentional actuation. Trigger housing 23-1 may be formed of any suitable metallic and/or polymeric material. In one non-limiting example, the trigger housing may be formed of heat-stabilized, glass-filled, polymer which may be injection molded.

The firing mechanism 23 may include the following components mounted in the trigger housing 23-1: a pivotable and cockable hammer 25; pivotable sear 26 which is configured and operable to hold the hammer in a rear cocked position (see, e.g. FIG. 3); a sear disconnector 27 operably engaged with the sear; and disconnector spring 27-1 acting between the disconnector and sear. Hammer 25 is biased forward by hammer strut-spring assembly 31. Pulling the trigger 24 rearward operates to lift disconnector 27 which in turn rotates the sear 26. This disengages a hook or ledge 28 formed on the front of the sear from a downward facing sear notch 29 on the hammer 25, thereby releasing spring-biased hammer 25 forward which strikes the rear end of firing pin 30 slidably carried by the bolt 50. This drives the firing pin forward to strike a chambered cartridge held in the chamber 36 of the barrel 22 for discharging the firearm 20.

Bolt 50 has an axially elongated block-like body of generally rectilinear (e.g. rectangular cuboid) shape having a monolithic unitary structure. Front end 52 of bolt 50 defines the vertical breech face that engages the breech end 38 of the barrel 22 adjacent the cartridge chamber 36 when the breech is closed. FIGS. 4, 7, and 10 show the bolt breech face at front end 52 spaced rearward from the breech end 38 of barrel 22 in an open breech position. Bolt 50 is received and axially movable in the internal cavity 40 of the receiver 21 along longitudinal axis LA between forward closed breech and rearward open breech positions. In the closed breech position, the bolt 50 is in battery with the rear breech end 38 of barrel 22 to close the chamber 36 for firing. In the open breech position, the bolt is axially displaced rearward to allow a spent cartridge casing to be ejected and for loading a fresh cartridge into the breech area of the receiver for chambering by the bolt when returned forward to the closed breech position. Firing pin 30 is mounted in an upwardly open and longitudinally-extending firing pin slot 30-1 formed in the bolt body. The rear end of firing pin 30 remains exposed at the rear end 53 of the bolt for striking by the hammer 25 to discharge the firearm via a trigger pull. It bears noting that the firing pin 30 shown is for a rimfire firearm since the forward striking end of the firing pin is transversely offset from longitudinal axis LA and barrel bore 37. This positioning allows the firing pin to strike the peripheral rim area of the cartridge rear in a known manner for rimfire-fired firearms.

A bolt handle-recoil spring assembly is coupled to the bolt 50 to manually cycle the bolt between its forward and rearward positions by hand. Bolt 50 is also automatically moved under recoil forces between the forward and rearward positions when the action is cycled after discharging the firearm to eject a spent cartridge casing and chamber a new fresh cartridge. Cavity 40 of receiver 21 therefore has an axial length sufficient to provide the full range of motion necessary for the bolt assembly 50 moving rearward under recoil to open the breech for extracting and ejecting a spent cartridge casing, and uploading a new cartridge into the barrel chamber 36 from the magazine 33.

The bolt handle assembly comprises transversely oriented cocking handle 51. Handle 51 has a transversely elongated body which is received and nests at least partially in an upwardly open transverse socket 52-1 formed proximate to the front end 52 of the bolt 50. The operating end of the handle 51 may include a cylindrical knob for grasping or have another shape such as a curved bar configured for engaging a finger. The opposite spring seating end 51-2 of handle 51 is coupled to a recoil spring guide rod and seats one end of a recoil spring (not shown) which automatically returns the bolt 50 forward.

Referring to FIG. 4, a manually actuated bolt release 100 is also provided for holding the bolt 50 rearward in an open breech position for various reasons. For example, one such reason is to allow visual inspection of the chamber to ensure that a round of ammunition does not remain when placing the firearm in a safe condition in preparation for maintenance or repair of the firearm. Another reason is to allow a round to be manually chambered if the magazine is empty. The bolt release of the firearm acts as a lock which selectably holds the bolt rearward until manually released by the user through some additional action.

The free-floating barrel mounting system with balanced moment forces which enhances shooting accuracy will now be described in further detail.

Referring generally to FIGS. 1-14, an insertion-type unthreaded coupling is formed between the rear breech end 38 of barrel 22 and receiver 21. The breech end 38 of barrel 22 defines a mounting end having a plain tubular cylindrical shape. Cylindrical breech end 38 of the barrel, which defines chamber 36, is insertably received into a complementary configured circular barrel mounting bore or hole 210 formed in the vertical front surface or face 211 at the front end 18 end of receiver 21. Mounting hole 210 is unthreaded and has a circular cross-sectional shape of slightly larger diameter than the breech end 38 of the barrel to allow insertion therein. When fully inserted into the receiver 21 as shown in FIGS. 4, 7, and 10, the vertical front face 211 of the receiver which is square with mounting hole 210 abuttingly engages the vertical annular rear surface or face 213 of an external annular shoulder 212 formed on barrel 22 between the smaller diameter cylindrical rear breech end 38 and larger diameter forward portion of the barrel. Shoulder 212 may be located approximately at the point of transition where the chamber 36 ends at front and the adjoining bore 37 continues towards the barrel muzzle end 39 in one embodiment. The mounting hole 210 defines a passageway from the front face 211 of receiver 22 into the front portion of longitudinally-extending cavity 40 which defines the breech area. This allows the front breech face of the bolt to come into battery with the rear breech end 38 at chamber 36 to form a closed breech within the receiver.

Receiver 21 includes a lower cantilevered forward extension 214 arranged below the barrel mounting hole 210 beneath the barrel 22. The forward extension 214 extends axially parallel to but below the longitudinal axis LA of the firearm. Forward extension 214 cradles and supports the rear end of barrel 22. In one embodiment, the forward extension 214 of receiver 22 defines an upward facing and arcuately curved concave barrel support surface 215 which is radiused from side to side to complement the outer cylindrical shape of the barrel forward of the smaller diameter cylindrical breech end 38 in configuration (this portion of the barrel remaining outside barrel mounting hole 210 in the receiver). This provides conformal contact between barrel and receiver forward extension 214 when the barrel is fully inserted into the receiver. Support surface 215 is concentric with barrel mounting hole 210 in the receiver.

As shown in FIGS. 4, 7, and 10, the cantilevered forward extension 214 of receiver 21 further defines a downwardly open threaded socket 216 which engages the front takedown screw 21-1 for securing forearm 83 of the stock to the receiver. The rear takedown screw 21-1 is received in another threaded socket 216 at the rear end 19 of the receiver. In one embodiment, the rear threaded socket may be formed in a detachable mounted block 21-2 secured to the rear of the receiver 21 by a threaded fastener 21-3 such as a cap head screw 21-3 (see, e.g. FIGS. 4-6).

In order to secure the barrel 22 to the receiver 21, the free floating barrel mounting system includes an upper above barrel bore centerline mounting feature in addition to a lower below bore centerline mounting feature. Without the above bore mounting feature, or alternatively contact with and support by the stock which would negate forming a free floating barrel mounting system and its inherent benefits, the barrel would be biased downward which may not fully optimize shooting accuracy.

Referring generally to FIGS. 4-14, the lower barrel mounting feature generally comprises a transversely elongated V-shaped clamping block 200 threadably secured to the receiver 21 by at least one, but preferably a pair of laterally spaced apart threaded securement fasteners 201. Fasteners 201 may be socket head cap screws for example in one embodiment as shown; however, other type screws may be used. Fasteners 201 each have a threaded shank and an enlarged head relative to the shank. Clamping block 200 defines a laterally extending and rear facing concave V-notch 222 formed by a pair of angularly converging planar bearing surfaces 207 (upper and lower). Surfaces 207 intersect a flat vertical bearing surface 208 therebetween at the base of the notch 222. A pair of laterally spaced unthreaded axial through bores 209 extend completely through the clamping block 200 from the front surface to the angular notch 222 as shown for receiving fasteners 201. The through bores 209 and fasteners 201 are axially and horizontal oriented parallel to longitudinal axis LA.

The forward extension 214 of receiver 21 has a truncated convex wedge end 217 formed by a pair of converging bearing surfaces 218 separated by a vertical bearing surface 219 in a similar vane to clamping block notch 222. Wedge end 217 is complementary configured to V-notch 222 of the clamping block. A pair of laterally spaced threaded axial holes 220 are formed in forward extension 214 of receiver 21 which receive threaded fasteners 201. Threaded holes 220 in forward extension 214 are concentric to unthreaded through bores 209 in clamping block 200.

To complete the lower barrel mounting feature, a transversely extending channel 205 is recessed into the bottom surface of barrel 22 which receives the upper portion of clamping block 200 therein as shown in FIGS. 4, 7, and 10. Channel 205 defines a forward facing angled bearing surface 221 which engages the upper bearing surface 207 in the V-notch 222. Bearing surface 221 thus has a complementary angle to bearing surface 207 as shown.

To secure the barrel 22 to receiver 21 via clamping block 200, the cylindrical rear breech end 38 of the barrel is inserted into the barrel mounting hole 210 in the front end of the receiver if not already done so. Securement fasteners 201 are inserted completely through the block to threadably engage their respective axial holes 220 in the receiver forward extension 214. The fasteners tightly draw the clamping block 200 into engagement with the barrel bearing surface 221 in channel 205 and the truncated wedge end 217 of the forward extension 214. This in turn tightly draws the barrel external shoulder 212 at the rear portion of the barrel against the flat front face 211 of the receiver 21 to secure the connection, thereby abutting rear annular face 213 against the barrel to the receiver front face. The interface between all of the foregoing mating angled bearing surfaces 207, 218, and 221, and front face 211 and rear face 213 is one of flat-to-flat.

Referring generally to FIGS. 4-10, the upper barrel mounting feature which balances the moment forces created by tightening the lower barrel mounting feature generally comprises a single upper threaded securement fastener 202, threaded axial bore 203 formed in the front face 211 of receiver 21 above and parallel barrel mounting hole 210, and a forward facing bearing surface 204 formed on the top of the barrel 22 proximate to rear barrel shoulder 212. Fastener 202 may be a socket head cap screw for example in one embodiment as shown; however, other type screws may be used. Fastener 202 has a threaded shank and an enlarged head relative to the diameter of the shank. In one embodiment, the bearing surface 204 is created in a securement recess 206 formed in the top surface of barrel 22. The securement recess 206 preferably has a depth large enough to receive a portion of the enlarged head of securement fastener 202; the rear facing surface of which engages the forward facing bearing surface 204 of the barrel. The vertically oriented flat rear wall of the recess 206 (perpendicular to longitudinal axis LA) defines the bearing surface 204 in one embodiment which is located below the top surface of the barrel completely within the recess. Bearing surface 204 thus does not protrude upwards beyond the top surface of the barrel in the illustrated embodiment. In other possible constructions, however, at least portions of the bearing surface 204 may rise above the top surface of barrel 22, and optionally the recess 206 may be omitted in other embodiments.

The foregoing recessed bearing surface 204 of barrel 22 is a preferred but not limiting construction since it allows for a compact interface with the receiver 21, and furthermore does not interfere with the forward cantilevered extension of the rail section 223 atop the receiver 21 which protrudes over the rear portion of the barrel (see, e.g. FIG. 4). In one embodiment, rail section 223 may be formed integrally with the receiver as a unitary monolithic structural part thereof. Rail section 223 may have any configuration used to mount accessories on the firearm such as scopes or sights.

In order to access the head of the securement fastener 202 for inserting and tightening the fastener (or conversely for loosening and removing the fastener), a forwardly open access passage 224 may be formed on the underside of the rail section 223 to access the threaded axial bore 203 of receiver 21, as shown in FIGS. 4, 7, and 10. Access passage 224 may be semi-circular in transverse cross section in one embodiment and covers/conceals the securement fastener 202 when fully installed.

To facilitate insertion and entry of the enlarged head of upper securement fastener 202 into the securement recess 206 on top of barrel 22 from the front, an arcuately curved concave lead-in chamfer 225 may be provided which communicates with the recess (see, e.g. FIGS. 4, 7, and 10-12). Chamfer 225 may have a maximum depth less than the recess 206 in one embodiment as illustrated. The lead-in chamfer 225 may gradually blend into the top surface of the barrel 22 at front such that the chamfer has a sloped or inclined bottom surface that gradually deepens going rearward along the barrel (best shown in FIG. 10). The deepest portion of chamfer 225 is at the entry point into the barrel top securement recess 206.

Figure 11:
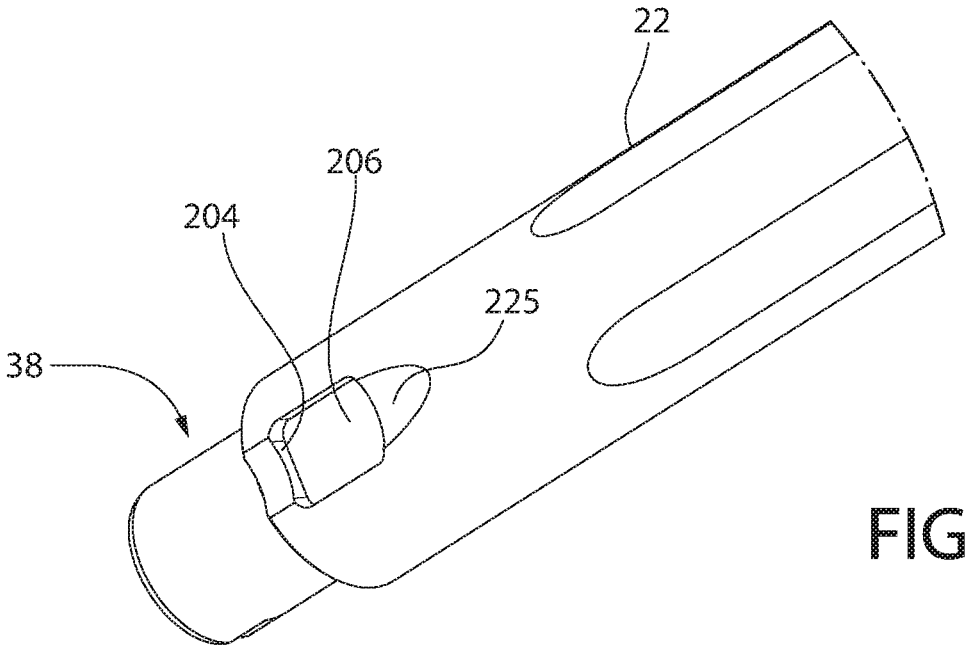
FIG. 11 is a rearward looking top perspective view of the top surface of the rear breech end portion of the barrel.
Figure 12:
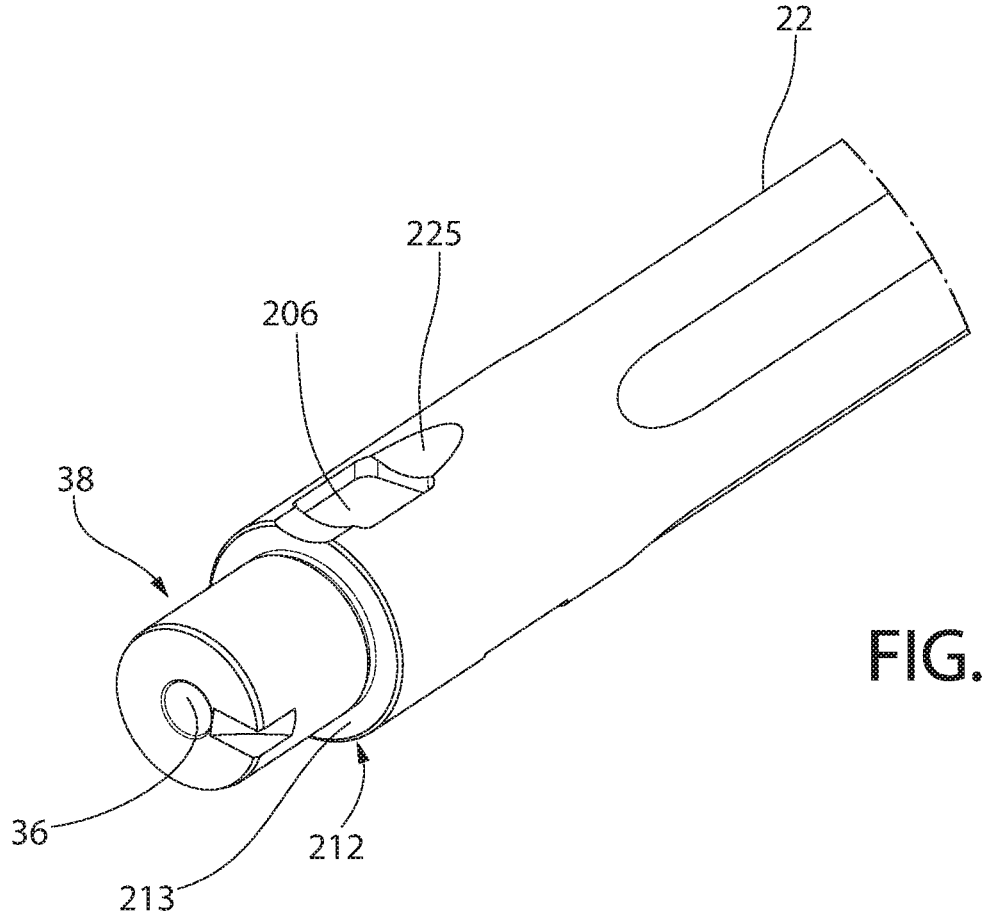
FIG. 12 is a forward looking top perspective view thereof.

In one embodiment, the recess 206 in the top surface of barrel 21 may have a rectilinear configuration in top plan view, such as square or rectangular (see, e.g. FIGS. 11 and 12). This forms four flat perpendicularly oriented walls of the recess as shown. Other shaped recesses however are possible. The top recess 206 of barrel 22 is preferably formed just forward and proximate or adjacent to the rear external shoulder 212 of the barrel (see also FIG. 4). This location represents the rearmost portion of the barrel 22 when mounted to the receiver 21 since the smaller diameter cylindrical breech end 38 of the barrel is inserted into the barrel mounting hole 210 in the front face of the receiver.

To secure the barrel 22 to the receiver 21 using the upper barrel mounting feature, the cylindrical rear breech end 38 of the barrel is first inserted into the barrel mounting hole 210 in the front end of the receiver if not already done so. Securement fastener 202 is then inserted through access 224 in rail section 223 and threadably engaged with threaded axial bore 203 formed in the front face 211 of receiver 21. This positions the enlarged head of securement fastener 202 into securement recess 206 (see, e.g. FIGS. 4, 7, and 10).

It bears noting that the top securement recess 206 of barrel 22 is located entirely beneath the top rail section 223 of receiver 21 when the breech end 38 of the barrel is fully inserted into the barrel mounting hole 210 of the receiver (see, e.g. FIGS. 7 and 10). The lead-in chamfer 255 serves provides additional clearance for the diametrically enlarged head of upper securement fastener 202 to enter the tight space between the rear portion of barrel 22 and the underside of rail section 223 and slide into the barrel top securement recess 206.

With continuing reference to FIGS. 4, 7, and 10, as the upper securement fastener 202 is rotated and tightened, the rear facing vertical surface of the enlarged fastener head abuttingly engages the forward facing bearing surface 204 of the barrel formed in top recess 206 of the barrel. This tightly draws the barrel external shoulder 212 at the rear portion of the barrel against the flat front face 211 of the receiver 21 to secure the connection. The interface between the head of securement fastener 202 and upper barrel bearing surface 204 is one of flat-to-flat. The threaded shank of the upper securement fastener 202 remains outside of the recess 206 and threadably engaged with threaded axial bore 210 in the front face of the receiver as shown in FIG. 4.

In one embodiment, as shown, it bears noting that the upper securement fastener 202 is preferably centered over the top surface of the barrel 22 and the barrel mounting hole 210 of the receiver 21 equidistance between the sides of the receiver. The vertical reference plane VR intersects the upper securement fastener 202 and the longitudinal axis LA, and further falls equidistant between the two laterally spaced apart lower securement fasteners 201 (see, e.g. FIG. 8). The upper fastener 202 may thus be considered "centered" in lateral position between the lower fasteners 201 albeit vertically spaced above the lower fasteners.

Figure 8:
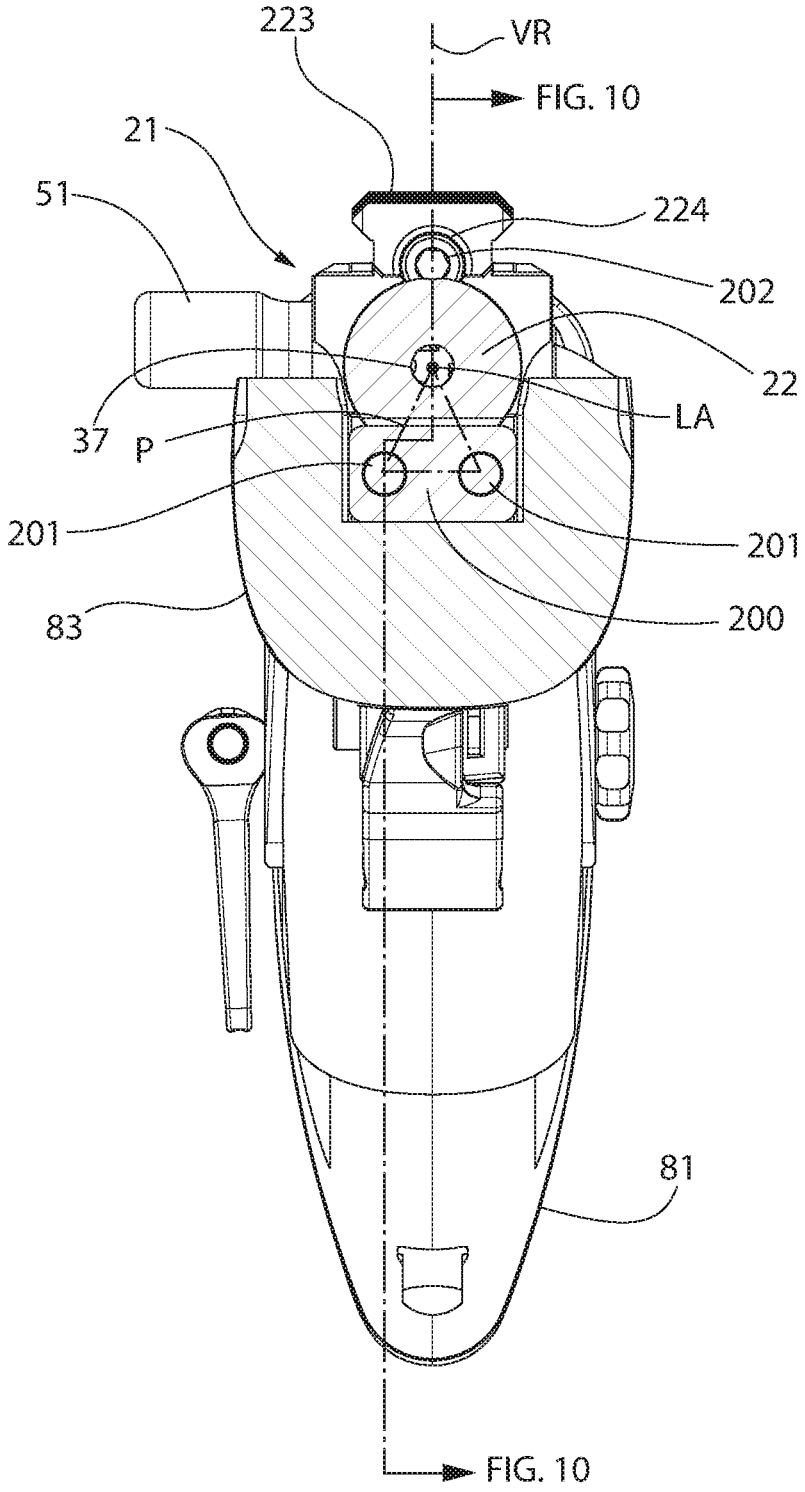
FIG. 8 is a first transverse cross-sectional view taken through the barrel to receiver interface.
Figure 9:
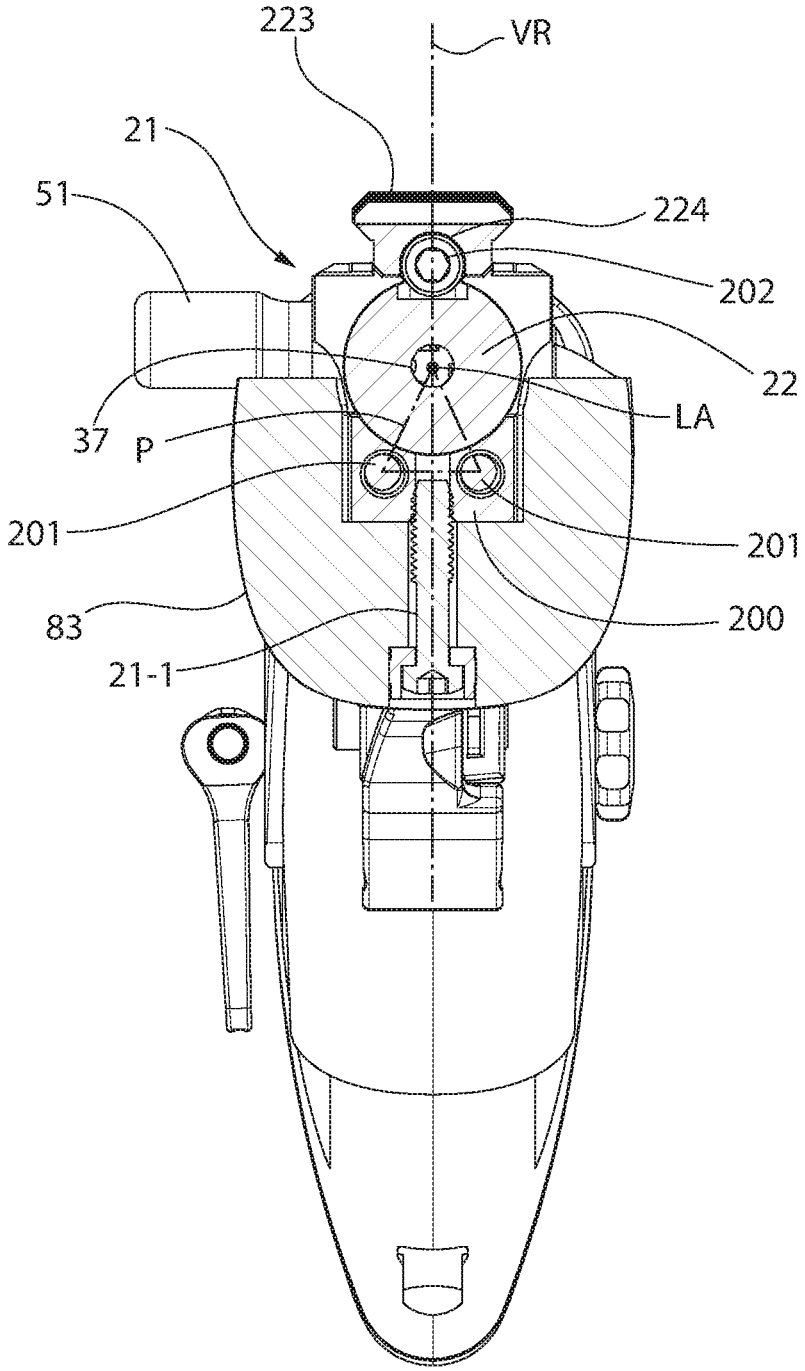
FIG. 9 is a second transverse cross-sectional view taken through the barrel to receiver interface.

When viewed looking rearward along the barrel towards its breech end 38 as seen in FIGS. 8 and 9, the three securement fasteners 201, 202 form a triangular bolting pattern P. This triangular bolting pattern results in the single upper securement fastener 202 balancing the moment forces created by tightening the two laterally spaced apart lower securement fasteners 201, thereby creating a free floating barrel mount to the receiver which is neither biased upwards nor downwards by the compressive forced created via tightening the securement fasteners. The barrel 22 receives no supportive contact from the stock 80 and is cantilevered from the receiver 21. This type of free-floating mounting enhances shooting accuracy.

A process or method for coupling a firearm barrel 22 to receiver 21 according to the present disclosure will now be briefly summarized with reference to FIG. 4 showing the completed assembly. The coupling is performed before the barrel-receiver assembly is attached to the stock 80 in order to gain access to the lower mounting feature of the barrel mounting system (i.e. clamping block 200 and securement fasteners 201).

The user first axially aligns the barrel 22 with the receiver 21. The breech end 38 of the barrel is then slidably inserted rearward into barrel mounting hole 210 in the front end 18 of the receiver until the external shoulder 212 (rear surface or face 213) of the barrel abuttingly engages the front surface or face 211 of the receiver. Clamping block 200 is then inserted into the downwardly open bottom transverse channel 205 of the barrel 22, and engaged with the receiver forward extension 214 by inserting its front truncated wedge end 217 into the V-shaped notch 222 of the block 200. The lower securement fasteners 201 are then inserted rearward through the block 200 and threadably engaged with the receiver 21. Fasteners 201 are tightened to draw the block 200 into full engagement with the barrel and receiver, thereby clamping and compressing the lower rear portion of the barrel 22 against the receiver below the bore centerline of the barrel.

Next in the coupling process or method, the upper securement fastener 202 is then inserted rearward through access 224 in rail section 223 and threadably engaged with threaded axial bore 203 formed in the front face 211 of receiver 21. This concurrently positions the enlarged head of securement fastener 202 into securement recess 206 on the top of the barrel (see, e.g. FIGS. 4, 7, and 10). Fastener 202 is tightened which abuttingly engages the enlarged head of the fastener with bearing surface 204 within recess 206, thereby drawing the upper rear portion of barrel 22 into full compressive engagement against the receiver above the bore centerline of the barrel.

In some embodiments, the upper securement fastener 202 may instead be installed before the lower securement fasteners 201. The order is not limiting of the invention.

After the barrel 22 has been coupled to the receiver 21, the stock 80 may be secured to the barrel-receiver assembly by installing and threading the takedown screws 21-1 through the stock into their respective threaded sockets 216 in the bottom of the receiver 21. This completes fully assembly of the firearm 20.

Figure 3:
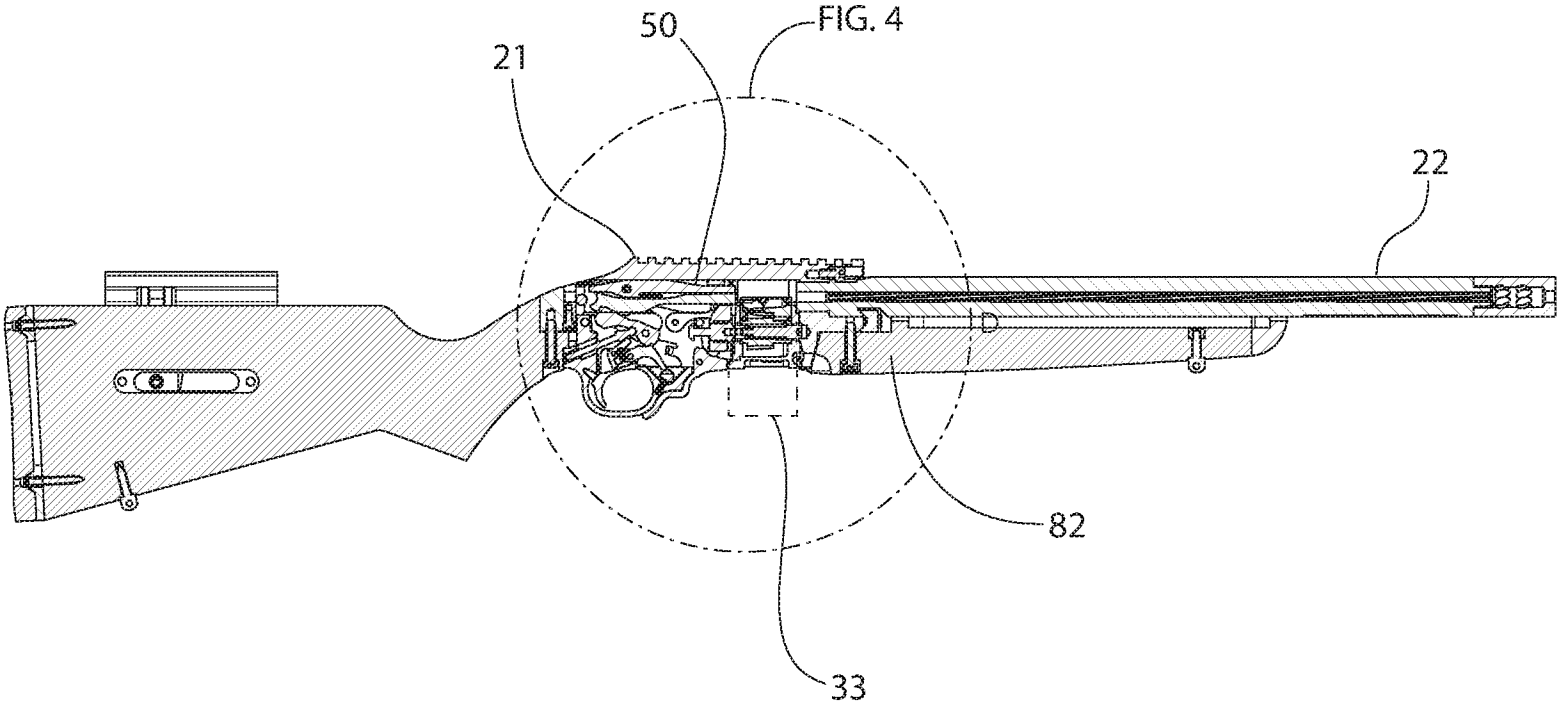
FIG. 3 is a right side cross-sectional view of the firearm of FIG. 1.

Notably, as seen in FIGS. 3, 4, and partially in FIG. 10, the fully installed barrel 22 is free floating meaning that it is not physically constrained in any manner by the stock 80 and is supported only by the receiver 21 at its rear breech end 38 in a cantilevered manner via the upper and lower barrel mounting features described herein. There is no supportive engagement or contact of the barrel with the stock 80 with a clearance provided between the stock and barrel along its length. Accordingly, the shooting accuracy is advantageously not adversely affected by any constraining forces originating from the stock. In addition, the moment forces created by tightening the upper and lower fasteners 202, 201 are balanced so that the barrel 22 is neither biased upwards nor downwards which might affect the line of sight and accuracy. The barrel is thus square with the front face of the receiver 21 to which it is coupled.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A free-floating barrel mounting system for a firearm comprising: a longitudinal axis;

a receiver;

a barrel detachably coupled to the receiver, the barrel comprising a front muzzle end, a rear breech end, and an internal bore defining a bore centerline and extending axially between the ends to define a projectile passageway;

a lower mounting feature below the bore centerline comprising a clamping block arranged in proximity to the breech end of the barrel, the clamping block configured to compress a lower portion of the breech end against a front face of the receiver;

a pair of spaced apart lower securement fasteners extending axially through the clamping block and threadably engaging the receiver;

an upper mounting feature vertically aligned above the bore centerline comprising an upper securement fastener configured to threadably engage the receiver and compress an upper portion of the breech end of the barrel against the front face of the receiver;

wherein moment forces created by the lower mounting feature are balanced by the upper mounting feature;

wherein the upper securement fastener compressively engages a forward facing upper bearing surface formed on a top center of the barrel adjacent the rear breech end to draw a rear face of the barrel against the front face of the receiver.

2. The barrel mounting system according to claim 1, further comprising an axially elongated stock coupled to and supporting the receiver, wherein the barrel is not supported by the stock thereby defining a free-floating barrel system.

3. The barrel mounting system according to claim 1, wherein the breech end of the barrel is cylindrical and insertably received in a complementary configured unthreaded barrel mounting hole in the front face of the receiver.

4. The barrel mounting system according to claim 1, wherein the upper securement fastener includes an enlarged head which engages the upper bearing surface of the barrel.

5. The barrel mounting system according to claim 4, wherein the upper bearing surface is formed within a securement recess in a top surface of the barrel, the head of the upper securement fastener received at least partially in the recess to engage the upper bearing surface.

6. The barrel mounting system according to claim 5, further comprising an inclined lead-in chamfer adjoining the recess to facilitate entry of the head of the upper securement fastener into the recess.

7. The barrel mounting system according to claim 5, wherein a threaded shank of the upper securement fastener remains outside of the recess and threadably engages a threaded axial bore in the front face of the receiver.

8. The barrel mounting system according to claim 1, further comprising a rail section atop the receiver defining a forwardly open axial access hole, the upper securement fastener being received through the access hole and threadably engaging a threaded axial bore in the front face of the receiver.

9. The barrel mounting system according to claim 3, further comprising an external shoulder formed between the cylindrical rear breech end of the barrel and a larger diameter forward portion of the barrel, the shoulder defining an annular rear face of the barrel which abuts the front face of the receiver around the barrel mounting hole.

10. The fife barrel mounting system according to claim 1, wherein the lower mounting feature further comprises a pair of spaced apart lower securement fasteners extending axially through the clamping block which threadably engage the receiver.

11. The barrel mounting system according to claim 10, wherein the receiver further comprises a lower forward extension having a truncated wedge end engaging a complementary configured V-shaped notch formed in the clamping block.

12. The barrel mounting system according to claim 11, wherein V-shaped notch further engages a forward facing bearing surface on a bottom of the barrel.

13. The barrel mounting system according to claim 10, wherein the lower securement fasteners and upper securement fastener define a triangular bolting pattern.

14. The barrel mounting system according to claim 1, wherein the upper securement fastener is centered over the barrel and axially oriented parallel to the longitudinal axis.

15. A free-floating barrel mounting system for a firearm comprising:

a longitudinal axis;

a receiver defining a front face and a forward extension projecting axially from the front face;

a barrel comprising a front muzzle end, a rear breech end, and an internal bore defining a bore centerline and extending axially between the ends to define a projectile passageway;

the breech end of the barrel being cylindrical and received in an unthreaded barrel mounting hole in the front face of the receiver;

an external shoulder formed between the breech end and a portion of the barrel forward of the breech end, the shoulder defining an annular rear face abuttingly engaged with the front face of the receiver;

a clamping block arranged below the bore centerline and engaged with the forward extension of the receiver;

a pair of spaced apart lower securement fasteners extending axially through the clamping block and threadably engaging the forward extension of the receiver;

an upper securement fastener arranged above and vertically aligned with the bore centerline and threadably engaging an axial bore in the front face of the receiver, the upper securement fastener being symmetrically centered in lateral position between the lower securement fasteners;

a portion of the upper securement fastener abuttingly engaging a forward facing upper bearing surface formed on a top center of the barrel;

wherein tightening the upper securement fastener compresses the annular rear face of the barrel against the front face of the receiver;

wherein moment forces created by tightening the lower securement fasteners are balanced by the upper securement fastener.

16. The barrel mounting system according to claim 15, wherein the upper securement fastener includes an enlarged head which directly engages the upper bearing surface of the barrel.

17. The barrel mounting system according to claim 16, wherein the upper bearing surface is formed within a securement recess in a top surface of the barrel, the head of the upper securement fastener received at least partially in the recess to engage the upper bearing surface.

18. The barrel mounting system according to claim 17, further comprising an inclined lead-in chamfer adjoining the recess to facilitate entry of the head of the upper securement fastener into the recess.

19. The barrel mounting system according to claim 17, wherein a threaded shank of the upper securement fastener remains outside of the recess and threadably engages the threaded axial bore in the front face of the receiver.

20. The barrel mounting system according to claim 15, wherein the forward extension comprises a truncated wedge end engaged with a complementary configured V-shaped notch formed in the clamping block.

21. The barrel mounting system according to claim 20, wherein V-shaped notch defines an angled bearing surface which engages both the truncated wedge end of the forward extension and a forward facing bearing surface on a bottom of the barrel.

22. The barrel mounting system according to claim 10, wherein the lower securement fasteners and upper securement fastener define a triangular bolting pattern.

23. A method for coupling a barrel to a receiver of a firearm, the method comprising:

axially aligning the barrel with the receiver;

slideably inserting a rear breech end of the barrel into a corresponding barrel mounting hole in a front end of the receiver;

abuttingly engaging a rear face of the barrel with a front face of the receiver;

engaging a lower forward portion of the receiver with a clamping block below a bore centerline of the barrel;

inserting a pair of lower securement fastener through the clamping block;

threadably engaging the pair of lower securement fasteners with the receiver;

tightening the lower securement fasteners to draw and clamp a bottom portion of the barrel against the front face of the receiver;

threadably engaging an upper securement fastener with the receiver vertically aligned above the bore centerline of the barrel to trap a forward facing upper bearing surface formed on a top center of the barrel between an enlarged head of the upper securement fastener and the receiver; and tightening the upper securement fastener to draw a top portion of the barrel against the front face of the receiver;

wherein moment forces created by tightening the lower securement fasteners is balanced by the upper securement fastener.

24. The method according to claim 23, wherein the upper securement fastener is centered in lateral position over the barrel between the lower securement fasteners forming a triangular bolting pattern.

25. The method according to claim 23, wherein the step of engaging the lower forward portion of the receiver with the clamping block includes inserting a front truncated wedge end defined by the lower portion into a complementary configured rearwardly open V-shaped notch of the clamping block.

26. The method according to claim 23, further comprising inserting the clamping block into a downwardly open bottom transverse channel of the barrel before the engaging step.

27. The method according to claim to 23, wherein the step of threadably engaging the upper securement fastener with the receiver includes engaging an enlarged head of the upper securement fastener with a forward facing upper bearing surface on a top of the barrel.

28. The method according to claim 27, further comprising positioning the enlarged head of the upper securement fastener partially in an upwardly open recess formed in a top surface of the barrel adjoining the upper bearing surface of the barrel.

29. The method according to claim 23, wherein the step of threadably engaging the upper securement fastener with the receiver includes inserting the upper securement fastener through a forwardly open access passage in a rail section atop the receiver to access a threaded bore of the receiver above the barrel mounting hole.

30. The method according to claim 23, wherein the lower and upper securement fasteners are oriented parallel to a longitudinal axis of the firearm and form a triangular bolting pattern.

31. The method according to claim 23, further comprising after the barrel is coupled to the receiver, the steps of:

positioning the receiver at least partially in an upwardly open cavity of an elongated stock;

threadably engaging and tightening a first takedown screw with a downwardly open threaded socket formed in the forward portion of the receiver; and threadably engaging and tightening a second takedown screw with a downwardly open threaded socket formed in a rear portion of the receiver;

wherein the barrel is not supportingly engaged by the stock defining a free-floating barrel mounting arrangement.

* * * * *